US005365817A

United States Patent [19]

Maeda et al.

[11] Patent Number: 5,365,817

[45] Date of Patent: Nov. 22, 1994

[54] SHEET CUTTING APPARATUS

[75] Inventors: Hiroshi Maeda; Nobumitsu Takahashi, both of Shizuoka, Japan

[73] Assignee: Fuji Photo Film Co., Ltd., Kanagawa, Japan

[21] Appl. No.: 989,046

[22] Filed: Dec. 10, 1992

[30] Foreign Application Priority Data

Dec. 19, 1991 [JP] Japan ..... 3-335421

[51] Int. Cl.[5] ..... B26D 7/32; B65H 9/12

[52] U.S. Cl. ..... 83/256; 83/282; 83/456; 271/240

[58] Field of Search ..... 83/169, 176, 404.1, 83/408, 255, 256, 268, 282, 456, 451, 934, 461, 460; 414/788, 907, 789.1; 271/241, 238, 240

[56] References Cited

U.S. PATENT DOCUMENTS

| | | | |
|---|---|---|---|
| RE. 16,779 | 11/1927 | Maxner . | |
| 742,974 | 11/1903 | De Costa | 83/452 X |
| 1,421,868 | 7/1922 | Volkmere . | |
| 1,488,502 | 4/1924 | Hulscher | 83/452 |
| 3,528,332 | 9/1970 | Thumim | 83/461 |
| 3,662,636 | 5/1972 | Young | 83/71 |
| 3,672,249 | 6/1972 | Sasaki | 83/282 X |
| 3,887,088 | 6/1975 | Fernandez-Rana et al. . | |
| 4,452,113 | 6/1984 | Pearl | 83/451 X |
| 4,528,878 | 7/1985 | Gerber | 83/451 X |
| 4,641,555 | 2/1987 | Johnson et al. | 83/256 X |
| 4,765,791 | 8/1988 | Brandt et al. | 414/907 X |
| 4,790,223 | 12/1988 | Busch | 83/282 X |
| 4,984,516 | 1/1991 | Scalzitti et al. . | |
| 5,079,982 | 1/1992 | Antonissen | 83/282 X |
| 5,150,647 | 9/1992 | Mohr | 414/907 X |
| 5,209,149 | 5/1993 | Mohr | 83/452 X |

FOREIGN PATENT DOCUMENTS

| | | |
|---|---|---|
| 0252418 | 1/1988 | European Pat. Off. . |
| 55-89146 | 7/1980 | Japan . |
| 55-142293 | 10/1980 | Japan . |
| 58-4397 | 1/1983 | Japan . |
| 61-295947 | 12/1986 | Japan . |
| 414543 | 12/1966 | Switzerland . |
| 2164889 | 4/1986 | United Kingdom . |

*Primary Examiner*—Rinaldi I. Rada

*Attorney, Agent, or Firm*—Sughrue, Mion, Zinn, Macpeak & Seas

[57] ABSTRACT

A sheet cutting apparatus including an air removing mechanism and a sheet overlap preventing mechanism. The air removing mechanism includes an aligning device for pushing edges of a stack of sheets, which stack is placed on a table before being cut, towards a center of the stack to align the edges of the stack, and a cover member for covering the stack on the table such that the stack can be hermetically sealed, a pushing device for pushing the stack form above, and an evacuation device for removing air from a space between the table and the cover member to hermetically seal the space. The sheet overlap preventing mechanism is provided with a first restriction device for restricting a displacement of a plurality of stacks of cut sheets, with respect to a thickness direction of each of the stacks of cut sheets, and a second restriction device for restricting a displacement of portions to be cut off from the stacks of the cut sheets, with respect to a thickness direction of each of the portions to be cut off.

7 Claims, 7 Drawing Sheets

SHEET CUTTING APPARATUS

BACKGROUND OF THE INVENTION

1. Field of the Invention

This invention relates to a sheet cutting apparatus for cutting a stack of sheets. This invention particularly relates to a sheet cutting apparatus for cutting a stack of large-sized sheets into a plurality of small-sized stacks of sheets.

2. Description of the Prior Art

When a stack of large-sized sheets is to be cut into a plurality of small-sized stack of sheets, the stack of large-sized sheets has heretofore been inclined and vibrated so that the edges of the stacked large-sized sheets are aligned. The stack of large-sized sheets, the edges of which have thus been aligned, is then pushed by a press roll from above, and air is thereby removed from between the sheets. Thereafter, the stack of sheets is subjected to a trimming process, a process for cutting into medium-sized sheets, and a process for cutting into small-sized sheets, which processes are carried out in this order by an ordinary plain cutting machine.

The process for removing one stack of sheets from a plurality of stacks of sheets, the process for feeding a stack of sheets into a sheet cutting machine, and the process for piling up a plurality of stacks of cut sheets are typically automated. Also, various techniques have been proposed to facilitate the sheet cutting work. A technique for changing the direction of a stack of sheets on a sheet cutting machine is proposed in, for example, Japanese Unexamined Patent Publication No. 61(1986)-295947. Also, a technique for aligning the edges of stacked sheets on a sheet cutting machine in proposed in, for example, Japanese Unexamined Utility Model Publication No. 58(1983)-4397. Additionally, techniques for taking the stacks of cut sheets out of a sheet cutting machine are proposed in, for example, Japanese Unexamined Patent Publication 55(1980)-89146 and Japanese Unexamined Utility Model Publication No. 55(1980)-142293.

In order to increase the efficiency with which a series of processes for cutting stacks of sheets are carried out, and to decrease the working force required for such processes, it is desirable that all of the operations from the process for feeding stacks of sheets into a sheet cutting machine to the process for feeding the stacks of cut sheets out of the sheet cutting machine be automated. Heretofore, as described above, improvements have been carried out on each individual process, and the process for feeding a stack of sheets into a sheet cutting machine has been performed automatically. However, operations of the sheet cutting machine for cutting a stack of sheets have heretofore been carried out manually.

One of the reasons why the sheet cutting operations, which are the main operations in the sheet cutting machine, have heretofore been carried out manually is that some of the stacked sheets, and in particular, the sheets at the upper part of the stack of sheets, shift in position when the stack of sheet is cut, when the direction of the stack of sheets is changed on the sheet cutting machine, or when the stack of sheets is conveyed on the sheet cutting machine. As a result, problems often occur that the sheets when have been cut and are located adjacent to each other overlap each other. Therefore, it is necessary for an operator to monitor whether or not such an overlap of sheets occurs.

In general, a sheet cutting machine is constructed such that when a stack of sheets is cut, a cutting blade is pulled in the direction along which the stack of the sheets is to be cut while the cutting blade is moved downwardly. Therefore, when the stack of sheets is cut, some of the stacked sheets, and in particular, the sheets at the upper part of the stack of sheets, readily shift in position in the direction in which the cutting blade moves. If some of the stacked sheets thus shift in position, the sheets when have been cut and are located adjacent to each other easily overlap each other, and adverse effects occur on the cutting operations. For example, a stack of large-sized sheets is cut into a plurality of stacks of medium sized, long strip-like sheets. While the stacks of the medium-sized, long strip-like sheets are placed side by side with one another, they are simultaneously cut into a plurality of stacks of small-sized sheets in a direction which is normal to the direction along which the stack of large-sized sheets was cut into the stacks of the medium-sized sheets. In such cases, if the medium-size sheets overlap each other, the sheets cannot be cut accurately.

In cases where scratching of the surfaces of the sheets is allowable, the sheets can be prevented from shifting in position by removing air from the sheet stacks and causing the sheets of each sheet stack to closely contact one another by use of a press roll. However, in cases where the surfaces of the sheets easily undergo scratching or should be prevented from being scratched, strong pressing of the sheets by a press roll must be avoided. Therefore, in such cases, air cannot be sufficiently removed from the stack of sheets, and the sheets will easily shift in position. Accordingly, during the sheet cutting operation, it is necessary for the operator to monitor whether or not the sheets shift in position.

SUMMARY OF THE INVENTION

The primary object of the present invention is to provide a sheet cutting apparatus, wherein the sheets which have been cut and are located adjacent to each other are prevented from overlapping, and wherein operations for cutting a stack of sheets, e.g., operations for cutting a stack of large-sized sheets into a plurality of stacks of medium-sized sheets and cutting each of the stacks of the medium-sized sheets into a plurality of stacks of small-sized sheets, are carried out automatically.

Another object of the present invention is to provide an air removing apparatus for use in the sheet cutting apparatus.

The specific object of the present invention is to provide a sheet overlap preventing apparatus for use in the sheet cutting apparatus.

The present invention provides a sheet cutting apparatus for cutting a stack of a plurality of sheets, comprising:

i) an air removing mechanism provided with:
   a) an aligning means for pushing edges of the stack of sheets, which stack is placed on a table before being cut, towards a center part of the stack so as to align the edges of the stack of sheets,
   b) a cover member for covering the stack of sheets on the table so that the stack of sheets can be hermetically sealed,
   c) a pushing means for pushing the stack of sheets, which stack has been aligned by the aligning means and has been covered by the cover member, from above, and d) an evacuation means for removing air from the space between the table and the cover member to hermetically seal the space, and ii) a sheet overlap preventing mechanism including:

e) a first restriction means for restricting a displacement of a plurality of stacks of cut sheets into which the stack of sheets has been cut after the air removing step and which cut sheets are located adjacent to one another, the displacement being measured in a thickness direction of each of the stacks of cut sheets, and f) a second restriction means for restricting a displacement of portions to be cut off from the stacks of cut sheets, which cut sheets are located adjacent to one another and are to be further cut, the displacement being measured in a thickness direction of each of the portions to be cut off from the stacks of cut sheets.

The present invention also includes, in a sheet cutting apparatus for cutting a stack of a plurality of sheets, an air removing apparatus comprising:

i) an aligning means for pushing edges of the stack of sheets, which stack is placed on a table before being cut, towards a center part of the stack of sheets to thereby align the edges of the stack of sheets, ii) a cover member for covering the stack of sheets on the table so that the stack of sheets can be hermetically sealed, iii) a pushing means for pushing the stack of sheets, which stack has been aligned by the aligning means and has been covered by the cover member, from above, and iv) an evacuation means for removing air from a space between the table and the cover member to hermetically seal the space.

The present invention further includes a sheet cutting apparatus for cutting a stack of a plurality of sheets, a sheet overlap preventing apparatus comprising:

i) a first restriction means for restricting a displacement of a plurality of stacks of cut sheets into which the stack of sheets has been cut and which cut sheets are located adjacent to one another, the displacement being measured in a thickness direction of each of the stacks of cut sheets, and ii) a second restriction means for restricting a displacement of portions to be cut off from the stacks of cut sheets, which cut sheets are located adjacent to one another and are to be further cut, the displacement being measured in a thickness direction of each of the portions to be cut off from the stacks of cut sheets.

The term "stacks of cut sheets adjacent to one another" as used herein means, for example, a plurality of stacks of medium-sized, long strip-like sheets, into which stacks a stack of large-sized sheets has been cut and which stacks are placed side by side with and adjacent to one another.

The term "restricting a displacement in a thickness direction" as used herein means restricting the movement of the cut sheets in their thickness direction such that the sheets of each stack are prevented from overlapping upon the sheets of an adjacent stack. For such purposes, for example, a plurality of stacks of medium-shaped sheets, into which stacks are placed side by side with and adjacent to one another, may be slightly pushed from above by a holding plate, or the like. Also, both the restriction of the displacement in the thickness direction of the stacks of cut sheets and the movement of the stacked sheets in the horizontal direction (i.e., in the direction along which a cutting blade moves) may be carried out.

With the air removing apparatus in accordance with the present invention, the aligning means pushes the edges of the stack of sheets, which stack is placed on the table before being cut, towards the center of the stack of sheets and thereby aligns the edges of the stack of sheets. Also, the cover member covers the stack of sheets on the table such that the stack of sheets can be hermetically sealed. The pushing means pushes the stack of sheets, which stack has been aligned by the aligning means and has been covered by the cover member, from above. At the same time, the evacuation means removes air from the space between the table and the cover member to hermetically seal the space. Thus, air can be sufficiently removed from the stack of sheets such that the surfaces of the stacked sheets may not be scratched as in the conventional air removing technique using a press roll. Accordingly, even if the stacked sheets are of the type wherein the surfaces of the sheets are easily scratched, the stacked sheets can be kept in close contact with one another. Problems associated with the conventional device can thus be prevented. For example, sheets located at the upper part of the stack of sheets will not shift in position when the stack of the sheets is cut, and the entire stack of the sheets will not shift in position when the stack is conveyed. Also, the sheets which have been cut and are located adjacent to each other will not overlap. Thus, the sheet cutting operations can be carried out automatically. Also, with the air removing apparatus in accordance with the present invention, the edges of the stack of sheets can be aligned without the stack being inclined and vibrated. Therefore, the efficiency with which the air removing operation is carried out can be kept high.

With the sheet overlap preventing apparatus in accordance with the present invention, the first restriction means restricts the displacement of a plurality of stacks of cut sheets, into which the stack of sheets has been cut and which cut sheets are located adjacent to one another, the displacement being measured in a thickness direction of each of the stacks of cut sheets. Also, the second restriction means restricts the displacement of portions to be cut off from the stacks of cut sheets, which cut sheets are located adjacent to one another and are to be further cut, the displacement being measured in a thickness direction of each of the portions to be cut off from the stacks of cut sheets. Therefore, even if air removal from the stack of sheets cannot be carried out sufficiently as in the conventional technique, the problems of the conventional technique are prevented from occurring. For example, when the stacks of sheets are cut, conveyed, or their direction are changed, the sheets do not shift to the upper or middle part of an adjacent stack of the cut sheets i.e., the sheets do not overlap upon the cut sheets of the adjacent stack. Accordingly, the sheet cutting operations can be carried out automatically.

In the sheet cutting apparatus in accordance with the present invention, the air removing mechanism is provided with aligning means for pushing the edges of the stack of sheets, which stack is placed on the table before being cut, towards the center of the stack thereby aligning the edges of the stack. Also, the cover member of the air removing mechanism covers the entire stack of sheets on the table such that the stack of sheets can be hermetically sealed. The pushing means pushes the stack of sheets, which stack has been aligned by the aligning means and has been covered by the cover member, from above. At the same time, the evacuation means removes air from the space between the table and the cover member to hermetically seal the space. Therefore, air can be sufficiently removed from the stack of sheets such that the surfaces of the stacked sheets are not scratched as may occur in the conventional air removing technique using a press roll. Accordingly, even if the stacked sheets are of the type that are easily scratched, the stacked sheets can be kept in close contact with one another. Problems of the conventional technique can thus be prevented from occurring. For example, sheets located at the upper part of the stack of the sheets will not shift in position when the stack of the sheets is cut, and the stack of sheets will not shift in position when the stack of sheets is conveyed. Also, air can be quickly removed from the stack of sheets. Accordingly, with the sheet overlap preventing mechanism, the first restriction means restricts the displacement of a plurality of stacks of cut sheets into which the stack of sheets has been cut after the air removing step and which cut sheets are located adjacent to one another, the displacement being measured in a thickness direction of each of the stack of cut sheets. Further, the second restriction means restricts the displacement of portions to be cut off from the stack of cut sheets, which cut sheets are located adjacent to one another and are to be further cut, the displacement being taken in a thickness direction of each of the portions to be cut off from the stacks of cut sheets. Therefore, the problems of the conventional technique can be prevented from occurring. For example, when the stacks of sheets have been cut, conveyed, or when their directions are changed, the sheets of the sheet stacks do not shift to the upper or middle part of an adjacent stack of cut sheets. In this manner, both the air removing mechanism and the sheet overlap preventing mechanism prevent the sheets which have been cut and are located adjacent to one another from overlapping, and the sheet cutting operations can thus be carried out automatically.

As described above, with the sheet cutting apparatus, the air removing apparatus, and the sheet overlap preventing apparatus in accordance with the present invention, the sheets which have been cut and are located adjacent to one another can be prevented from overlapping, and the sheet cutting operations can thus be carried out automatically. Consequentially, the cutting of stacks of sheets can be completely automated. Also, the efficiency with which the sheet cutting operations are carried out is kept high, and the working force required for such processes is reduced.

DESCRIPTION OF THE PREFERRED EMBODIMENTS

The present invention will be described in further detail below with reference to the accompanying drawings.

Figure 1:
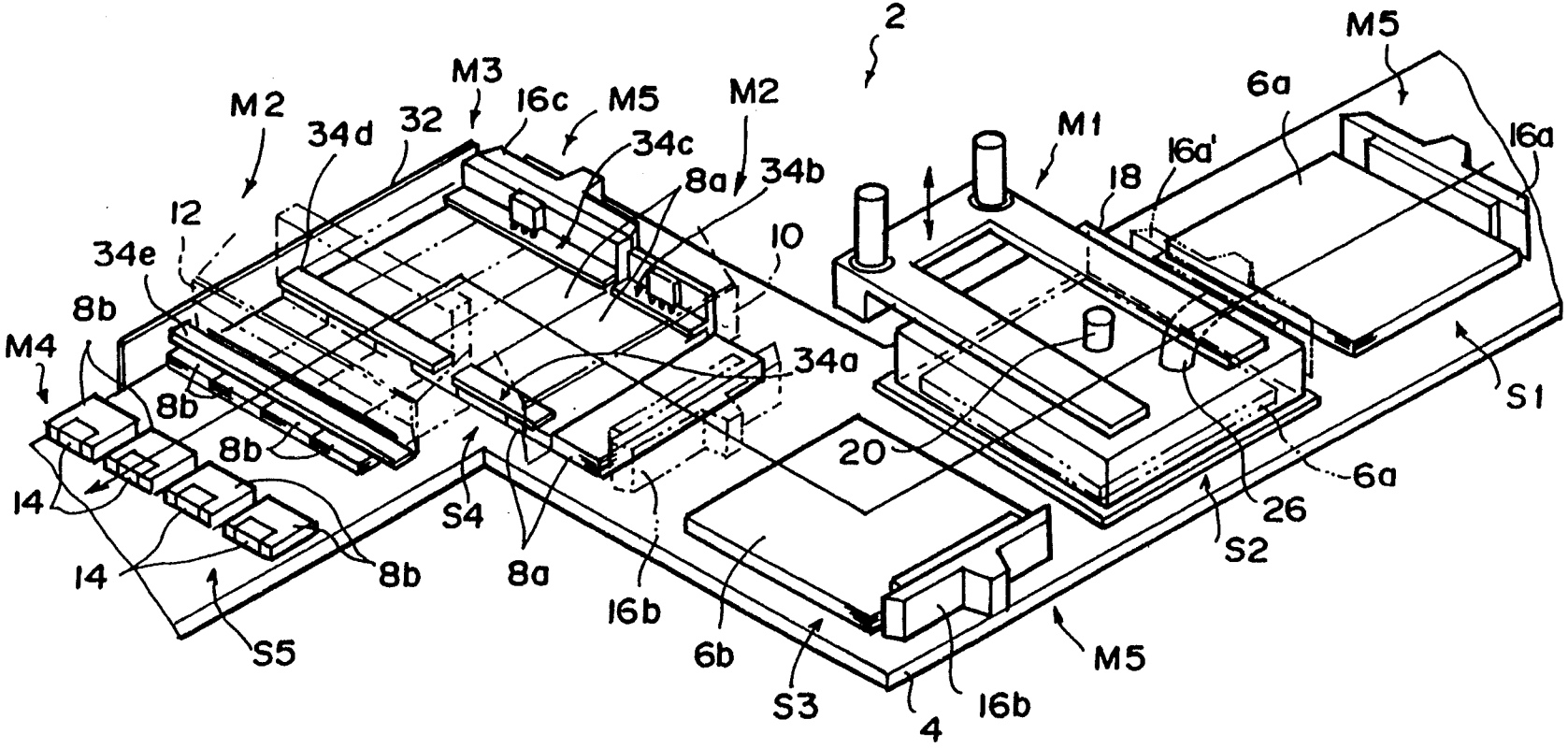
FIG. 1 is a perspective view showing an embodiment of the sheet cutting apparatus in accordance with the present invention.
Figure 2A:
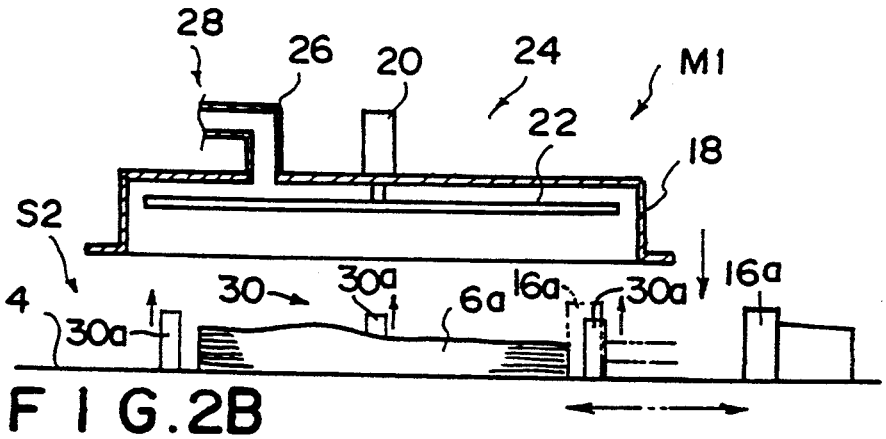
FIGS. 2A, 2B, 2C, and 2D are explanatory views showing how an air removing mechanism in the embodiment of FIG. 1 operates.
Figure 2B:
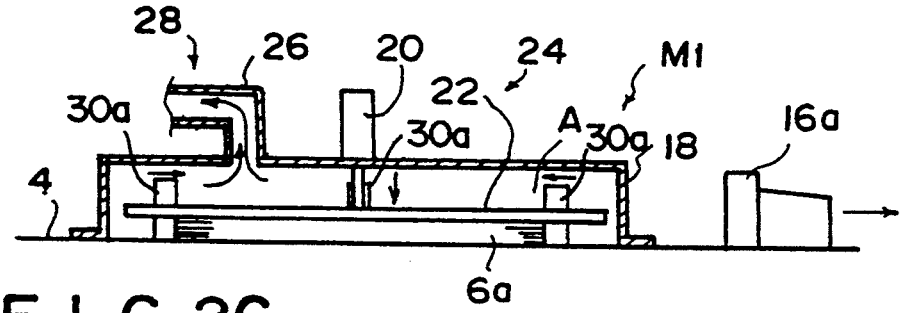
Figure 2C:
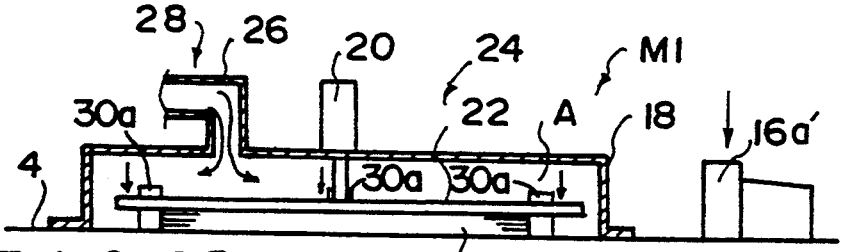

FIG. 1 is a perspective view showing an embodiment of the sheet cutting apparatus in accordance with the present invention. FIGS. 2A, 2B, 2C, and 2D are explanatory views showing how an air removing mechanism in the embodiment of FIG. 1 operates. FIG. 3 is a schematic view showing a sheet overlap preventing mechanism and a sheet cutting mechanism in the embodiment of FIG. 1.

With reference to FIG. 1, in a sheet cutting apparatus 2, a stack of large-sized sheets **6*a* is fed into a feed-in station S1, which is located on the right side in FIG. 1 on a table 4 having a crank-like shape. The stack of large-sized sheets 6*a* is cut into a plurality of stacks of predetermined, small-sized sheets 8*b*, 8*b*, . . . The stacks of the small-sized sheets 8*b*, 8*b*, . . . are then fed out from a feed-out station S5, which is located on the left side in FIG. 1**. The series of sheet cutting operations are carried out automatically.

As illustrated in FIG. 1, the sheet cutting apparatus 2 is provided with an air removing mechanism M1 for removing air from the stack of large-sized sheets **6*a* before the stack of the large-sized sheets 6*a* is cut. The sheet cutting apparatus 2 is also provided with a sheet cutting mechanism M2 for cutting a stack of large-sized sheets 6*n*, from which air has been removed. (In FIG. 1, in the sheet cutting mechanism M2, only cutting blades 10 and 12 are shown.) The sheet cutting apparatus 2 is additionally provided with a sheets overlap preventing mechanism M3 for preventing the sheets of a plurality of stacks of cut sheets, into which the stack of large-sized sheets 6*b* has been cut and which are located adjacent to one another, from overlapping one upon another. Specifically, the sheet overlap preventing mechanism M3 prevents the sheets of a plurality of stacks of medium-sized sheets 8*a*, 8*a*, . . . , into which the stack of large-sized sheets 6*n* has been cut and which are located adjacent to one another, from overlapping one upon another. The sheet overlap preventing mechanism M3 also prevents the sheets of the plurality of stacks of small-sized sheets 8*a*, 8*a*, . . . have been cut and which are located adjacent to one another, from overlapping one upon another. The sheet cutting apparatus 2 is further provided with a feed-out mechanism M4 for feeding out the stacks of small-sized sheets 8*b*, 8*b*, . . . from the sheet cutting apparatus 2. (in FIG. 1, in the feed-out mechanism M4, only grippers 14, 14, . . . are shown.) The sheet cutting apparatus 2 is still further provided with a conveyance mechanism M5 for conveying the stack of the large-sized sheets 6*a*, 6*b*, the stacks of medium-sized sheets 8*a*, 8*a*, . . . , and the stacks of small-sized sheets 8*b*, 8*b*, . . . along the stations on the table 4. The mechanisms of the sheet cutting apparatus 2** are controlled by, for example, an NC (numerical control) or CNC device.

With the sheet cutting apparatus 2, a series of sheet cutting processes are sequentially carried out in the manner described below. Specifically, the stack of a predetermined number of large-sized sheets 6*a* is fed from a preceding process, such as a sheeter process, into the feed-in station S1 shown in FIG. 1. The stack of large-sized sheets 6*a* is conveyed by a conveyance means 16*a* of the conveyance mechanism M5 from the feed-in station S1 into an air removing station S2. As shown in FIG. 2A, the air removing mechanism M1 is provided with an aligning means 30 for aligning up the edges of the stack of the large-sized sheets 6*a*, which has been conveyed into the air removing station S2. The air removing mechanism M1 is also provided with a cover member 18, which can move up and down and covers the stack of large-sized sheets 6*a* such that the stack of large-sized sheets 6*a* can be hermetically sealed on the table 4. The air removing mechanism M1 is additionally provided with a pushing means 24, which includes an air cylinder 20 connected to the cover member 18, and a pushing plate 22 moved up and down by the air cylinder 20, and which pushes the stack of large-sized sheets 6*a* from above. The air removing mechanism M1 is further provided with an evacuation means 28, which includes a duct connected to the cover member 18, and a suction device (not shown) connected to the duct 26, and which removes air from the space A between the cover member 18 and the table 4 to hermetically seal the space.

As illustrated in FIG. 2A, the stack of large-sized sheets 6*a* is conveyed by the conveyance means 16*a* to a predetermined position on the table 4. The table 4 is provided with the aligning means 30. The aligning means 30 is provided with a pair of pushing members 30*a*, 30*a* which are located on the front and rear sides with respect to the direction along which the stack of the large-sized sheets 6*a* is conveyed. The aligning means 30 is also provided with a pair of pushing members 30*a*, 30*a*, which are located on both lateral sides with respect to the direction along which the stack of the large-sized sheets 6*a* is conveyed. The aligning means 30 is also provided with a pair of pushing members 30*a*, 30*a*, which are located on both lateral sides with respect to the direction along which the stack of the large-sized sheets 6*a* is conveyed. (In FIG. 2A, only three pushing members 30*a*, 30*a*, 30*a* are shown.) The four pushing members 30*a*, 30*a*, 30*a*, 30*a* can protrude from and retract to a position under the table 4 and can reciprocally move a predetermined distance in the direction parallel to the surface of the table 4. The pushing members 30*a*, 30*a*, 30*a*, 30*a*, push the four edges of the stack of large-sized sheets 6*a* towards the center part of the stack and thereby align the edges of the stack. While the four edges of the stack of large-sized sheets 6*a* are being pushed by the pushing members 30*a*, 30*a*, 30*a*, 30*a*, the cover member 18 moves down and covers the stack of large-sized sheets 6*a* such that the stack of large-sized sheets 6*a* is hermetically sealed on the table 4.

In the manner described above, the edges of the stack of large-sized sheets 6*a* are pushed by the pushing members 30*a*, 30*a*, 30*a*, 30*a* of the aligning means 30, and the stack of large-sized sheets 6*a* is covered by the cover member 18. In this state, as illustrated in FIG. 2B, the upper surface of the stack of large-sized sheets 6*a* is pushed by the pushing means 24 from above, and air is removed from the stack of large-sized sheets 6*a*. Also, the evacuation means 28 removes air from the space A hermetically sealed between the cover member 18 and the table 4. So that the pushing members 30*a*, 30*a*, 30*a*, 30*a* of the aligning means 30 and the pushing means 24 do not interfere with each other, the pushing plate 22 of the pushing means 24 is provided with notches at positions corresponding to the pushing members 30*a*, 30*a*, 30*a*, 30*a*. As illustrated in FIG. 2C, after the space A is evacuated approximately to a vacuum state, it is returned to atmospheric pressure and the cover member 18 is removed.

Figure 2D:
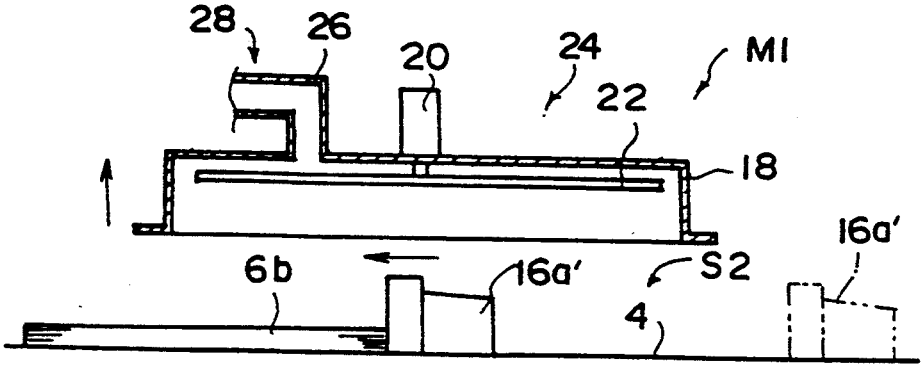
Figure 3:
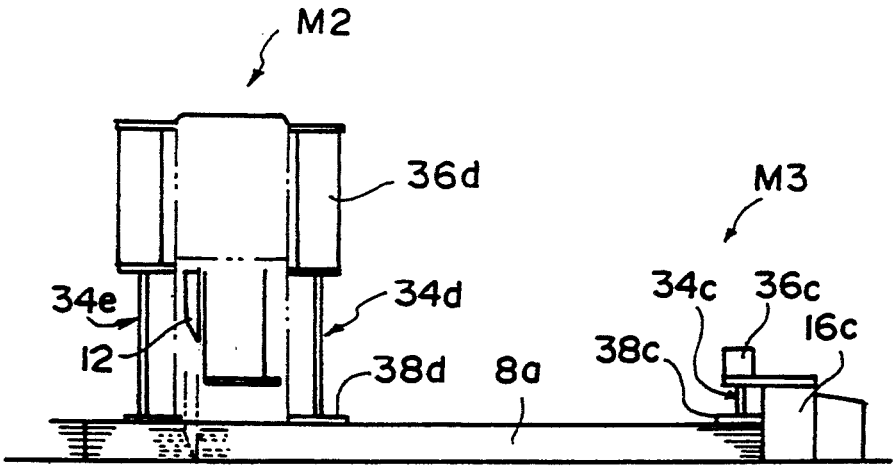
FIG. 3 is a schematic view showing a sheet overlap preventing mechanism and a sheet cutting mechanism in the embodiment of FIG. 1.

As illustrated in FIG. 2D, after air has been removed from the stack of large-sized sheets 6*b*, the cover member 18 moves up, and the pushing members 30*a*, 30*a*, 30*a*, 30*a* of the aligning means 30 retract to the position under the table 4. The stack of large-sized sheets 6*b*, from which air has been removed, is conveyed by a conveyance means 16*b* into a sheet cutting station S4. The stack of large-sized sheets 6*b*, which has been conveyed into the sheet cutting station S4, is intermittently moved a predetermined distance forwardly by the conveyance means 16*b* and is cut by the cutting blade 10 into a plurality of long strip-like stacks of medium-sized sheets 8*a*, 8*a*, . . . in accordance with a predetermined cutting width. The plurality of stacks of medium-sized sheets 8*a*, 8*a*, . . . are located adjacent to one another and conveyed by the conveyance means 16*b* until the forward end face of the stack of the medium-sized sheets 8*a*, which is located most forward in the direction along which the stacks of the medium-sized sheets 8*a*, 8*a*, . . . are conveyed by the conveyance means 16*b*, comes into contact with a stop plate 32. First restriction means 34*a*, 34*b*, 34*c*, and 34*d* of the sheet overlap preventing mechanism M3 are located on opposite sides of the plurality of the stacks of medium-sized sheets 8*a*, 8*a*, . . . , which are located adjacent to one another and conveyed in this state. The first restriction means 34*a*, 34*b*, 34*c*, and 34*d* of the sheet overlap preventing mechanism M3 restrict the displacement of the stacks of the medium-sized sheets 8*a*, 8*a*, . . . , which displacement is measured in the thickness direction of the stacks of medium-sized sheets 8*a*, 8*a*, . . . In this manner, the sheets of adjacent stacks 8*a*, 8*a*, . . . are prevented from overlapping one upon another.

How the sheet overlap preventing mechanism M3 is constituted will be described below with reference to the restriction means 34*c* and 34*d*. As illustrated in FIG. 3, the restriction means 34*c* includes an air cylinder 36*c*, which is secured to a conveyance means 16*c*, and a holding plate 38*c*, which is moved up and down by the air cylinder 36*c*. The restriction means 34*a* and 34*b* have the same construction and operate in the same manner. The restriction means 34*d* includes an air cylinder 36*d*, which is secured to the sheet cutting mechanism M2, and a holding plate 38*d*, which is moved up and down by the air cylinder 36*d*. The thicknesses of the stacks of medium-sized sheets 8*a*, 8*a*, . . . , the thickness of each of the sheets, and the like, are taken into consideration, and the positions of the holding plates 38*c* and 38*d* are set at predetermined positions. In this manner, the displacement of the stacks of medium-sized sheets 8*a*, 8*a*, . . . in their thickness direction is restricted.

In the manner described above, the plurality of stacks of medium-sized sheets 8*a*, 8*a*, . . . are located adjacent to one another and conveyed to the predetermined position while the medium-sized sheets of each of the stacks 8*a*, 8*a*, . . . are prevented by the sheet overlap preventing mechanism M3 from overlapping upon the sheets of an adjacent stack 8a. The direction of conveyance of the stacks of the medium-sized sheets 8a, 8a, . . . is then changed 90 degrees by the conveyance means 16c. The stacks of medium-sized sheets 8a, 8a, . . . , which stacks are located adjacent to one another, are intermittently moved a predetermined distance forward by the conveyance means 16c and are cut by the cutting blade 12 into a plurality of stacks of small-sized sheets 8b, 8b, . . . in accordance with a predetermined cutting width. A second restriction means 34e of the sheet overlap preventing mechanism M3 restricts a displacement of the portions (i.e., the stacks of small-sized sheets) 8b, 8b, . . . to be cut off from the stacks of medium-sized sheets 8a, 8a, . . . , which stacks are located adjacent to one another and are to be further cut, the displacement being measured in the thickness direction of each of the portions 8b, 8b, . . . In this manner, the sheets of each of the stacks of small-sized sheets 8b, 8b, . . . are prevented from overlapping upon the sheets of an adjacent stack 8b.

Figure 4:
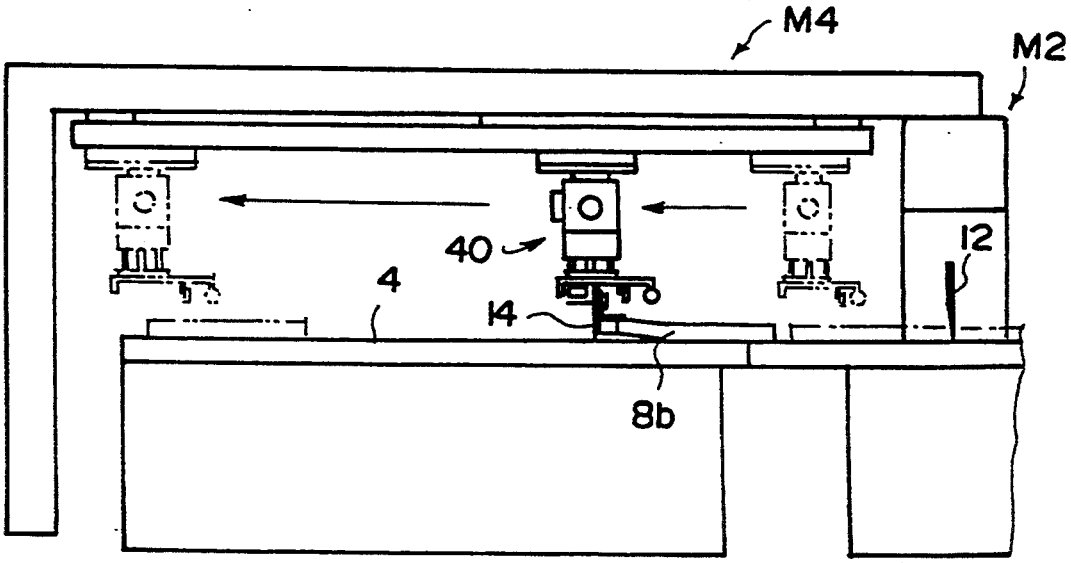
FIG. 4 is a schematic view showing a feed-out mechanism in the embodiment of FIG. 1.

The stacks of small-sized sheets 8b, 8b, . . . are conveyed by the feed-out mechanism M4 into the next process. As illustrated in FIG. 4, the feed-out mechanism M4 is provided with a plurality of gripping means 40, 40, . . . , each of which is provided with the griper 14 for gripping one of the stacks of small-sized sheets 8b, 8b, . . . and can move in the direction of the conveyance and in the direction normal to the direction of the conveyance. In this embodiment, the plurality of the stacks of small-sized sheets 8b, 8b, . . . are separated from one another and conveyed by the gripping means 40, 40, . . .

Figure 5:
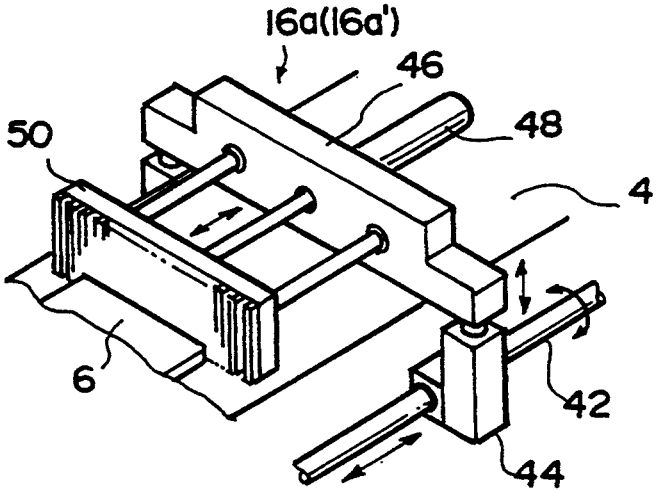
FIG. 5 is a perspective view showing an example of a conveyance means in the embodiment of FIG. 1, FIGS. 6A, 6B, 6C, and 6D are explanatory views showing how a conveyance mechanism in the embodiment of FIG. 1 operates.
Figure 6A:
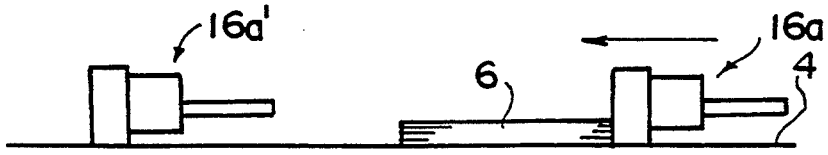
Figure 6B:
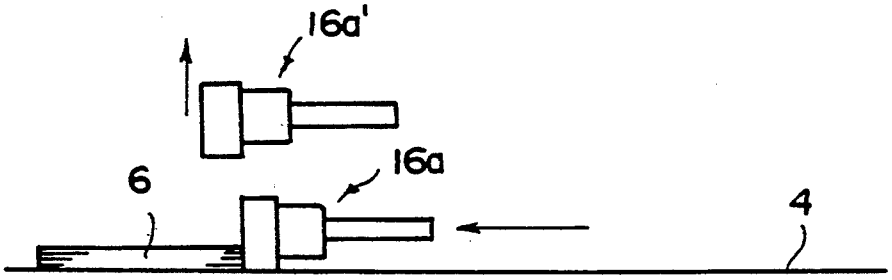
Figure 6C:
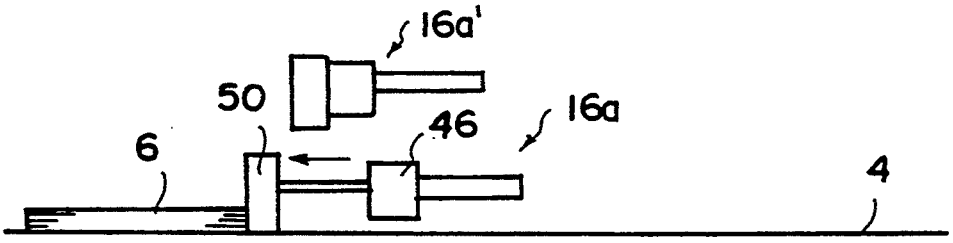
Figure 6D:
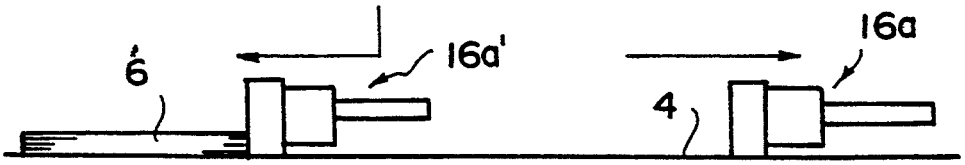

The manner in which the conveyance mechanism M5 operates in the aforesaid embodiment will be described hereinbelow. FIG. 5 is a perspective view showing an example of the conveyance means. FIGS. 6A, 6B, 6C, and 6D are explanatory views showing how the conveyance mechanism operates.

As illustrated in FIG. 5, by way of example, each of the conveyance means 16a and 16a$^1$ can be constituted of a back gauge body 46 and a sub-back gauge 50. The back gauge body 46 is secured to a rising means 44, which is engaged with a screw shaft 42 located along the table 4, such that the back gauge body 46 can be moved along the table 4 and can be moved up and down. The sub-back gauge 50 can be moved forward and backward in spaced relation to the back gauge body 46 by an air cylinder 48 which is connected to the back gauge body 46. As illustrated in FIGS. 6A, 6B, 6C, and 6D, the conveyance means 16a and 16a$^1$ are located such that they can move reciprocally between two predetermined positions on the table 4. In this manner, a stack of sheets 6 can be smoothly transferred from the conveyance means 16a to the conveyance means 16a$^1$ and the operating efficiency is high.

As described above, with the sheet cutting apparatus 2, air can be sufficiently removed by the air removing mechanism M1 from the stack of large-sized sheets 6a before being cut. Also, even if the stacked sheets are of the type such that the surfaces of the sheets easily undergo scratching, the stacked sheets are kept in close contact with one another without being scratched on their surfaces. Additionally, the sheet overlap preventing mechanism M3 restricts the displacement of the stacks of medium-sized sheets 8a, 8a, . . . , which stacks are located adjacent of each of the stacks. The sheet overlap preventing mechanism M3 also restricts the displacement of the portions 8b, 8b, . . . to be cut off from the stacks of medium-sized sheets 8a, 8a, . . . , which stacks of medium-sized sheets are located adjacent to one another and are to be further cut, the displacement being measured in the thickness direction of each of the portions 8b, 8b, . . . In this manner, both the air removing mechanism M1 and the sheet overlap preventing mechanism M3 prevent the sheets which have been cut and are located adjacent to one another from overlapping one upon another, and the sheet cutting operations can thereby be carried out automatically.

The sheet cutting apparatus in accordance with the present invention can be embodied in various other ways.

Figure 7:
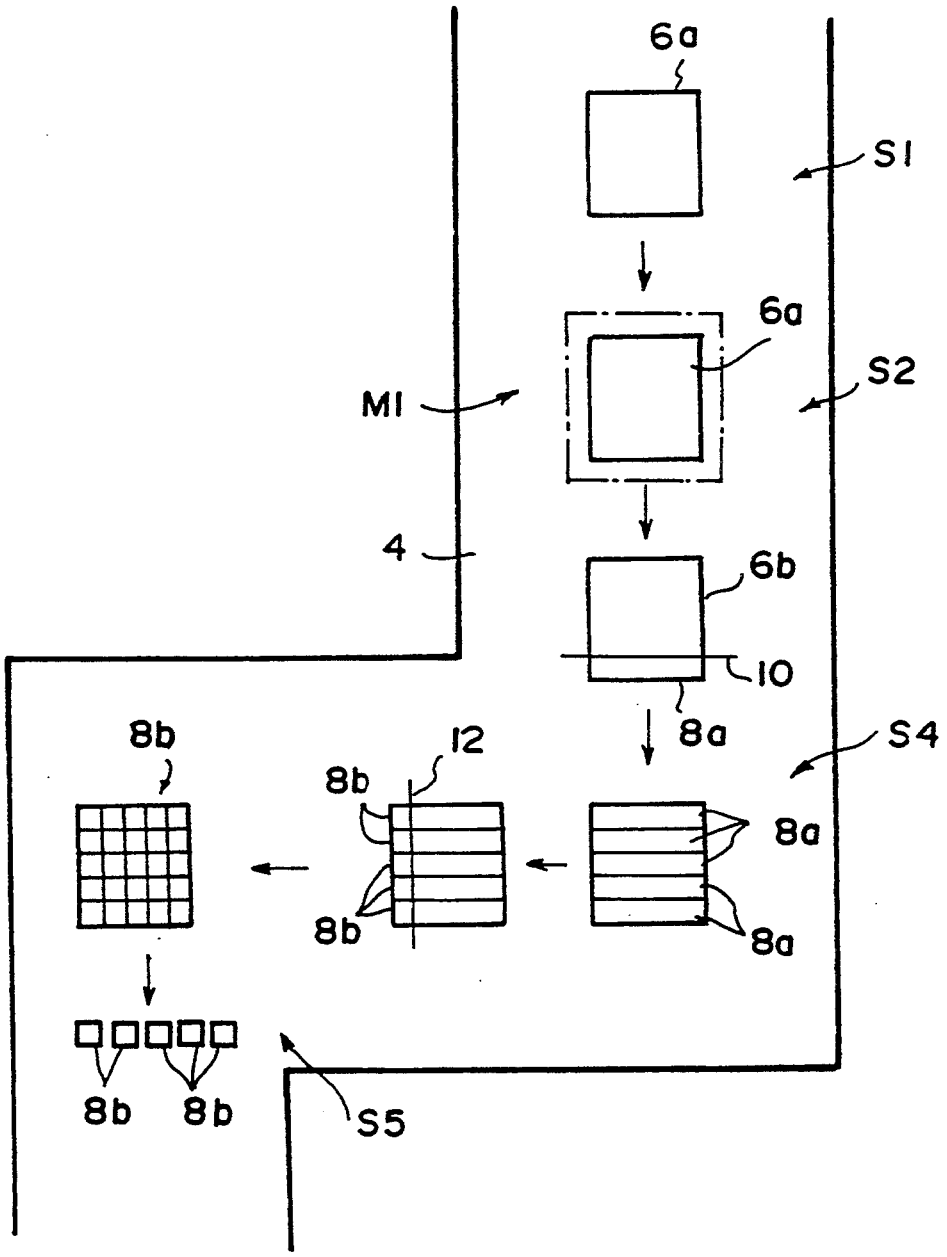
FIG. 7 is an explanatory view showing a different example of the flow of a sheet cutting process.
Figure 8:
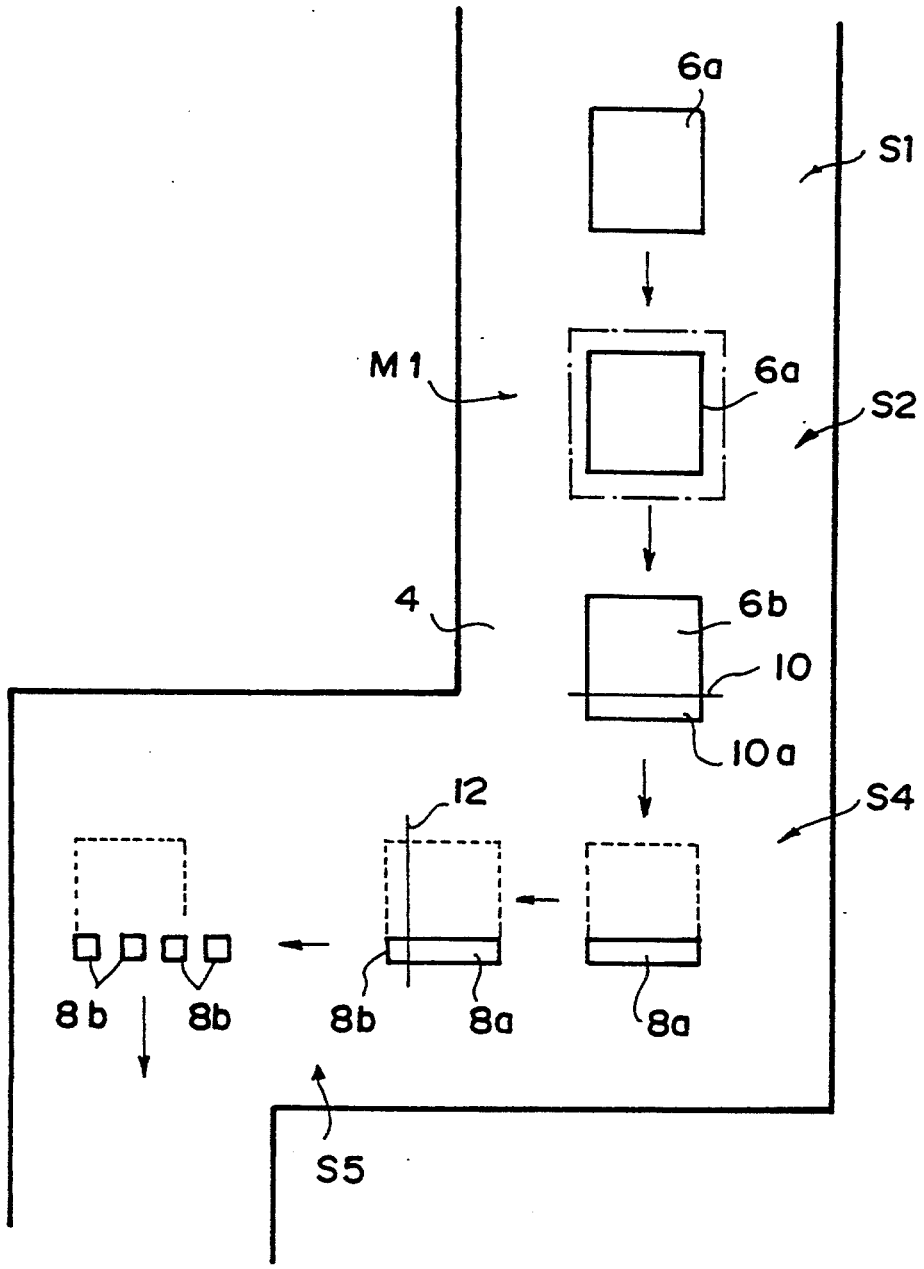
FIG. 8 is an explanatory view showing a further example of the flow of a sheet cutting process.

For example, the flow of the series of sheet cutting processes can be modified in various manners. FIGS. 7 and 8 show different examples of the flow of the sheet cutting processes. In FIGS. 7 and 8, similar elements are numbered with the same reference numerals with respect to FIG. 1. The flow of the sheet cutting processes shown in FIG. 7 is different from the flow shown in FIG. 1 in that the stack of large-sized sheets 6b, from which air has been removed, is cut into the stacks of medium-sized sheets 8a, 8a, . . . without the direction of the conveyance being changed, and in that the stacks of small-sized sheets 8b, 8b, . . . are not separated immediately after they are cut off from the stacks of medium-sized sheets 8a, 8a, . . . After the stacks of small-sized sheets 8b, 8b, . . . are cut off from the stacks of medium-sized sheets 8a, 8a, . . . , the stacks of small-sized sheets 8b, 8b, . . . are conveyed in adjacent relation to one another and are then separated from one another. The flow of the sheet cutting processes shown in FIG. 8 is different from the flow shown in FIG. 1 in that the stacks of medium-sized sheets 8a, 8a, . . . are separated from one another immediately after being cut from the stack of large-sized sheets 6b. The medium-sized sheet 10a is cut from the large-sized sheet 6b by the cutting blade 10. The stacks of medium-sized sheets 8a, 8a, . . . are then conveyed and cut into the stacks of small-sized sheets 8b, 8b, . . .

The air removing mechanism M1 and the sheet overlap preventing mechanism M3 employed in the aforesaid embodiment of the sheet cutting apparatus can constitute embodiments of the air removing apparatus and the sheet overlap preventing apparatus in accordance with the present invention.

What is claimed is:

1. A sheet cutting apparatus for cutting a stack of sheets, comprising:

an air removing mechanism comprising:

an aligning means for aligning edges of said sheets in the stack of sheets, said stack of sheets having been placed on a table before being cut, by pushing on opposing sides of said stack of sheets towards a center of the stack of sheets, thereby aligning the edges of each of said sheets to one another, a covering means for covering the stack of sheets on said table so that the stack of sheets is hermetically sealed on the table within a space between said table and said covering means, a pushing means for pushing the stack of sheets, each of said sheets in said stack of sheets having been aligned to one another by said aligning means and having been covered by said covering means, from above, an evacuating means for evacuating air from the space between said table and said covering means to hermetically seal said space between said table and said covering means thereby removing air between each of said sheets in said stack of sheets, a means for moving said covering means, and a means for returning said space between said table and said covering means to atmospheric pressure, a first cutting means for cutting the stack of sheets received from said air removing mechanism into a plurality of stacks of cut sheets, a second cutting means for cutting the plurality of stacks of cut sheets received from said first cutting means into a plurality of portions, and a sheet overlap preventing mechanism comprising:

a first restriction means for restricting movement of the plurality of cut sheets while said first cutting means is cutting the stack of sheets, in a direction perpendicular to a surface of stacks of cut sheets, and a second restriction means for restricting movement of said plurality of portions cut from said plurality of stacks of cut sheets while said second cutting means is cutting the plurality of stacks of cut sheets, said plurality of portions located adjacent to one another, said movement being in a direction perpendicular to a surface of each of said plurality of portions.

2. A sheet cutting apparatus as defined in claim 1 wherein said first restriction means comprise a plurality of holding plates located above said plurality of stacks of cut sheets, and wherein said holding plates move up and down to hold said plurality of stacks of cut sheets.

3. A sheet cutting apparatus as defined in claim 1 wherein said second restriction means is provided with a holding plated located above said plurality of portions, said holding plate being moved up and down to hold said plurality of portions.

4. In a sheet cutting apparatus for cutting a stack of sheets, an air removing apparatus comprising:

an aligning means for aligning edges of said sheets in the stack of sheets, said stack of sheets being placed on a table before being cut, by pushing on opposing sides of said stack of sheets towards a center of the stack of sheets, thereby aligning the edges of each of said sheets to one another, a covering means for covering the stack of sheets on said table such that the stack of sheets is hermetically sealed on the table within a space between said table and said covering means, a pushing means for pushing the stack of sheets, said stack of sheets having been aligned by said aligning means and having been covered by said covering means, from above, an evacuating means for evacuating air from the space between said table and said covering means to hermetically seal said space between said table and said covering means thereby removing air between each of said sheets in said stack of sheets, a means for moving said covering means, and a means for returning said space between said table and said covering means to atmospheric pressure.

5. In a sheet cutting apparatus for cutting a stack of sheets, a sheet overlap preventing apparatus comprising:

a first restriction means for restricting movement of a plurality of stacks of cut sheets located adjacent to one another, said movement being in a direction perpendicular to a surface of each of said plurality of stacks of cut sheets, and a second restriction means for restricting movement of a plurality of portions cut from said plurality of stacks of cut sheets, said plurality of portions located adjacent to one another, said movement being in a direction perpendicular to a surface of each of said plurality of portions.

6. A sheet overlap preventing apparatus as defined in claim 5 wherein said first restriction means comprise a plurality of holding plates located above said plurality of stacks of cut sheets, and wherein said holding plates move up and down to hold said plurality of stacks of cut sheets.

7. A sheet overlap preventing apparatus as defined in claim 5 wherein said second restriction means comprise a holding plate located above said plurality of portions, and wherein said holding plate is moved up and down to hold said portions cut from said plurality of stacks of cut sheets.

* * * * *